United States Patent [19]

Diekhoff

[11] Patent Number: 4,729,509

[45] Date of Patent: Mar. 8, 1988

[54] COIN COLLECTING APPARATUS

[75] Inventor: Robert R. Diekhoff, Harrison, Ark.

[73] Assignee: Qonaar Corporation, Rolling Meadows, Ill.

[21] Appl. No.: 56,047

[22] Filed: Jun. 1, 1987

[51] Int. Cl.[4] ..... G07B 15/00

[52] U.S. Cl. ..... 232/16; 232/7

[58] Field of Search ..... 232/7, 15, 16

[56] References Cited

U.S. PATENT DOCUMENTS

| | | | |
|---|---|---|---|
| 2,430,384 | 11/1947 | Broussard | 232/16 |
| 2,613,871 | 10/1952 | Broussard et al. | 232/16 |
| 2,815,166 | 12/1957 | Sollenberger | 232/16 |
| 3,807,628 | 4/1974 | Bock | 232/16 |
| 3,974,961 | 8/1976 | Dominick et al. | 232/16 |
| 4,177,889 | 12/1979 | Adams et al. | 232/16 X |

*Primary Examiner*—Robert W. Gibson, Jr.
*Attorney, Agent, or Firm*—James P. Ryther

[57] ABSTRACT

A coil collecting apparatus including a coin container defining a receiver housing. The housing is designed to receive a coin box taken from a parking meter or vending apparatus, and the box defines a closure which opens when the box is received in the housing and rotated. The housing defines a passage adapted to register with the coin box opening upon such rotation whereby the coins in the box can be discharged into the coin container. A cover is provided for the receiver housing, and the cover carries a coin box engaging head which engages the box when it is located in the housing and when the cover has been closed. A rotatable cover handle is provided for rotating the head and the engaged box. A locking bar is operatively connected to the cover, and this bar interfits with a blocking sleeve located within the receiver housing to hold the blocking sleeve in blocking position when the cover is open and until the cover is closed.

7 Claims, 5 Drawing Figures

FIG. 3
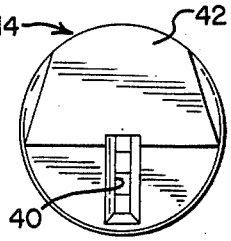
FIG. 2
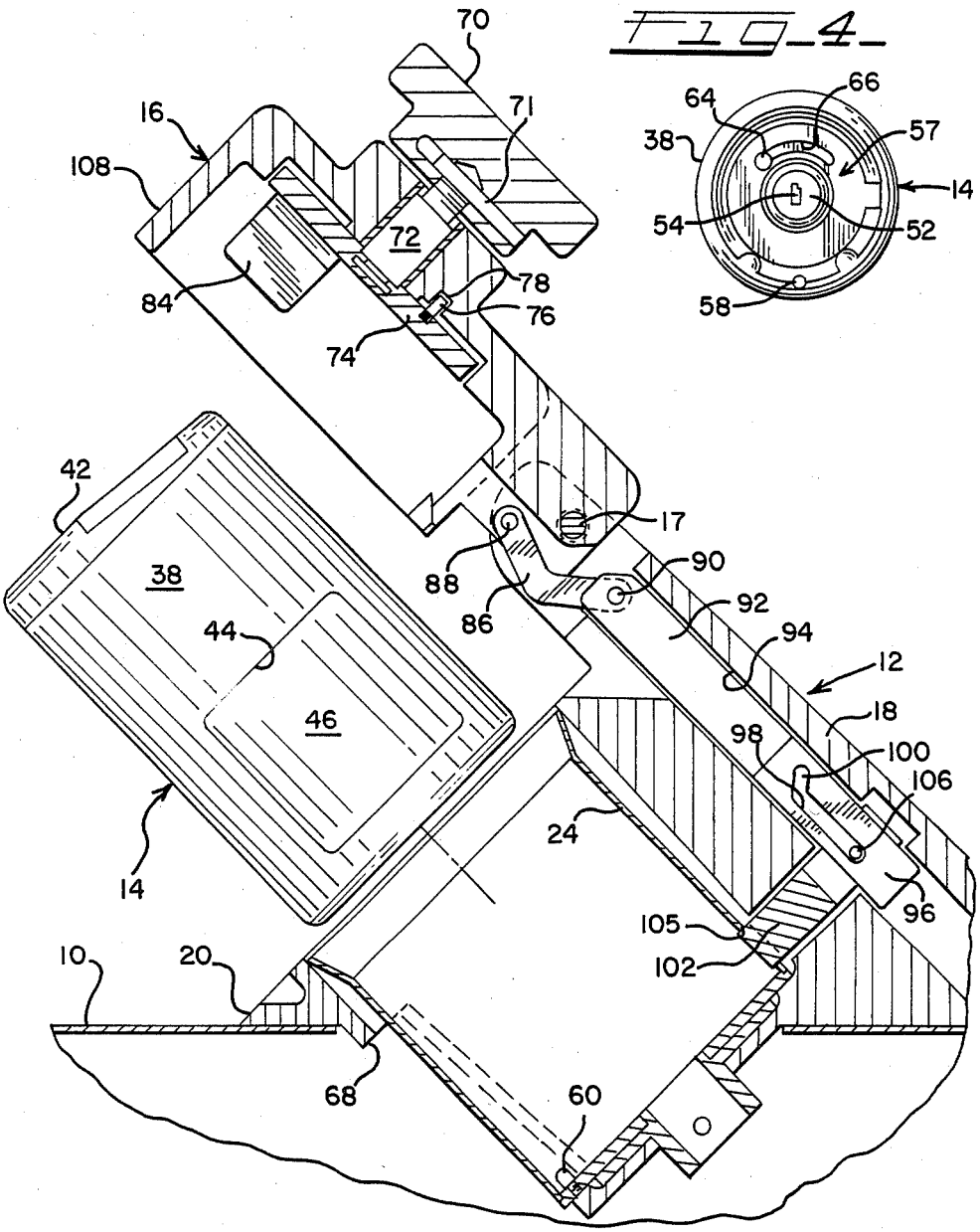
FIG. 4

70
88
86
90
80
76
82
92
84
96
98
32
62
24
28
30
36
34
17
12
18
20
106
104
102
56

COIN COLLECTING APPARATUS

BACKGROUND OF THE INVENTION

This invention relates to a coin collecting apparatus. The invention is particularly concerned with a coin collecting apparatus comprising a coin container and an associated receiver housing. The receiver housing is adapted to receive a coin box, and means are provided for discharging the contents of the coin box into the coin container while the coin box is retained in the receiver housing.

Sollenberger U.S. Pat. No. 2,815,166 discloses a coin collecting apparatus of the general type contemplated by this invention. This apparatus involves the use of a coin box which is receivable within a recess defined by a receiver housing of a coin container. A closure carried by the box, and a sleeve of the receiver housing are adapted to be opened upon rotation of the box within the receiver housing. When the closure is so-opened, the contents of the box are discharged into the container and at this point, the box is removed. The sleeve of the receiver housing prevents access to the interior of the coin container when the coin box is removed.

Various schemes have been developed with a view toward improperly obtaining coins which should be delivered to the coin container. In particular, attempts have been made to locate articles, such as pieces of paper or cardboard, in the area of discharge of coins from the coin box. When these articles are located in that position, some of the coins discharged can be caught by the articles and thereafter retrieved. This retrieval can be accomplished by gaining access to the area adjacent the receiver housing, and schemes have been developed to gain such access even when the coin box has been removed from the receiver housing.

Bock Pat. No. 3,807,628 discloses an apparatus designed to provide improved security means for constructions used for the collection of coins from individual coin boxes. In particular, this design provides means for displacing articles improperly located in the area of coin discharge from a coin box whereby free passage of coins from the coin box into a coin container can be achieved.

Dominick, et al. U.S. Pat. Nos. Re. 28,308 and 3,974,961 disclose a system of coin collection wherein coin boxes, as on buses, are moved to a central location and then have their contents discharged. These systems have security advantages, including the use of doors with drive means for achieving discharge of cash box contents, but they do not lend themselves to a movable collection system, such as a cart movable down the street from meter to meter, which is the type of system contemplated principally by Sollenberger and Bock.

The Sollenberger and Bock designs, in particular, have disadvantages, however, since the receiver housing of the coin container used in these systems is exposed during use. This is necessary since the coin box must be rotated by manually engaging the top of the box after it is in place. With the receiver housing and coin box exposed, opportunities for pilfering and vandalism are increased. In the latter connection, attempts at pilfering, even if unsuccessful, can cause damage to an apparatus, and it is, therefore, desirable to design such systems with a view toward minimizing access to parts needed for performing the desired function.

SUMMARY OF THE INVENTION

This invention contemplates a coin collecting system utilizing coin boxes as described in the Sollenberger and Bock patents, or some comparable coin box. The coin collecting container is also of a known type not forming a part of this invention. The receiver housing of the container, on the other hand, is designed especially for achieving the objects of this invention.

The receiver housing is provided with a cover so that the interior of the housing will not be exposed except when opened for inserting or removing a coin box. The cover includes an engaging means for cooperating with the top of a coin box, and the engaging means is rotatable. A handle is carried by the cover, and rotation of the handle will result in simultaneous rotation of the coin box once it has been properly engaged by the cover.

A locking bar and associated mechanism are provided for locking the receiver housing sleeve against rotation whenever the cover is in a fully or partially open condition. When this sleeve is locked against rotation, the coin box cannot be rotated and, therefore, the contents of the coin box, as well as of the main coin container, are maintained secure against unauthorized access.

The locking bar is controlled by means of a slide bar and associated linkage. In the preferred form of the invention, the linkage is such that even upon a slight opening of the cover, the locking bar will engage.

DESCRIPTION OF THE DRAWINGS

FIG. 2 is a vertical cross-sectional view of a coin box and of the receiver housing of FIG. 1 wherein the housing cover is shown in the open position;

FIG. 3 is a top view of the cash box;

FIG. 4 is a bottom view of the cash box; and,

DETAILED DESCRIPTION OF THE INVENTION

Figure 1:
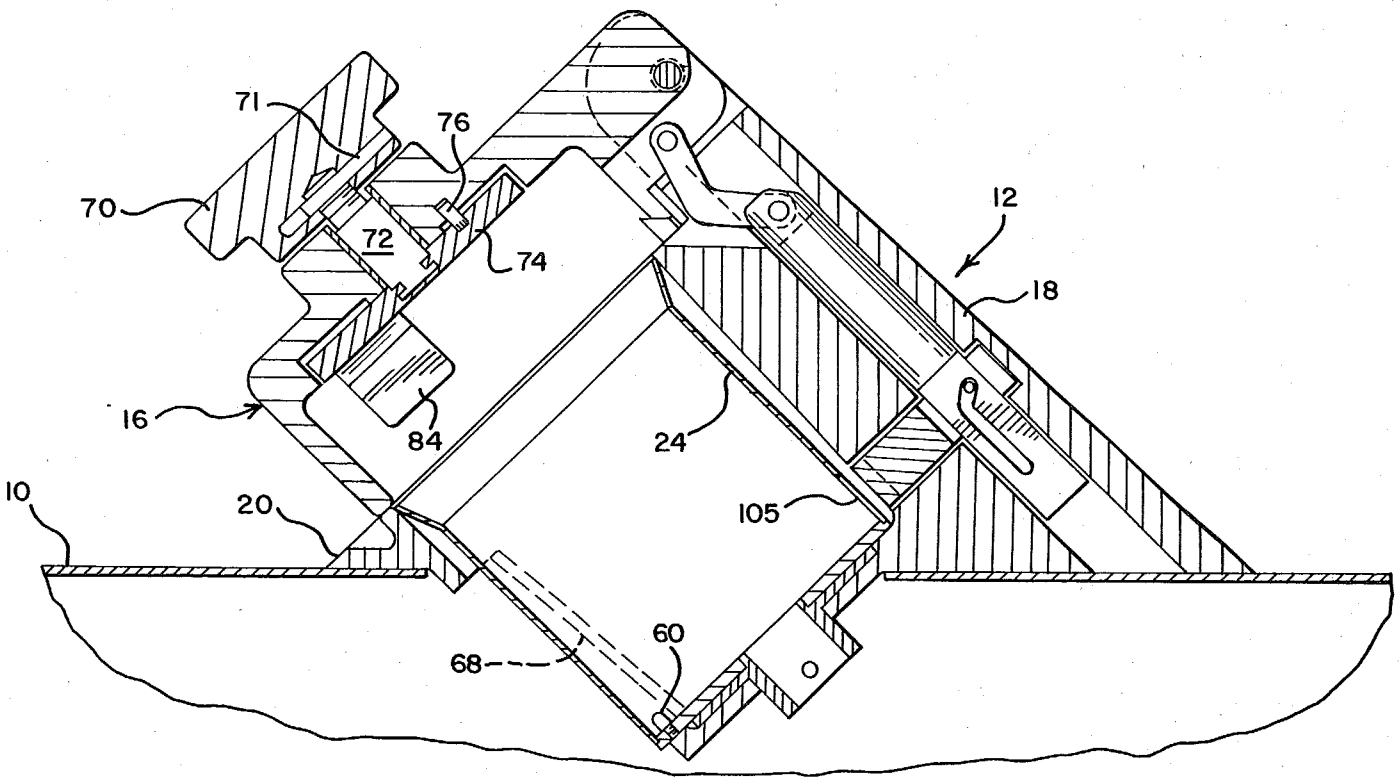
FIG. 1 is a vertical cross-sectional view of a receiver housing characterized by the features of this invention.
Figure 5:
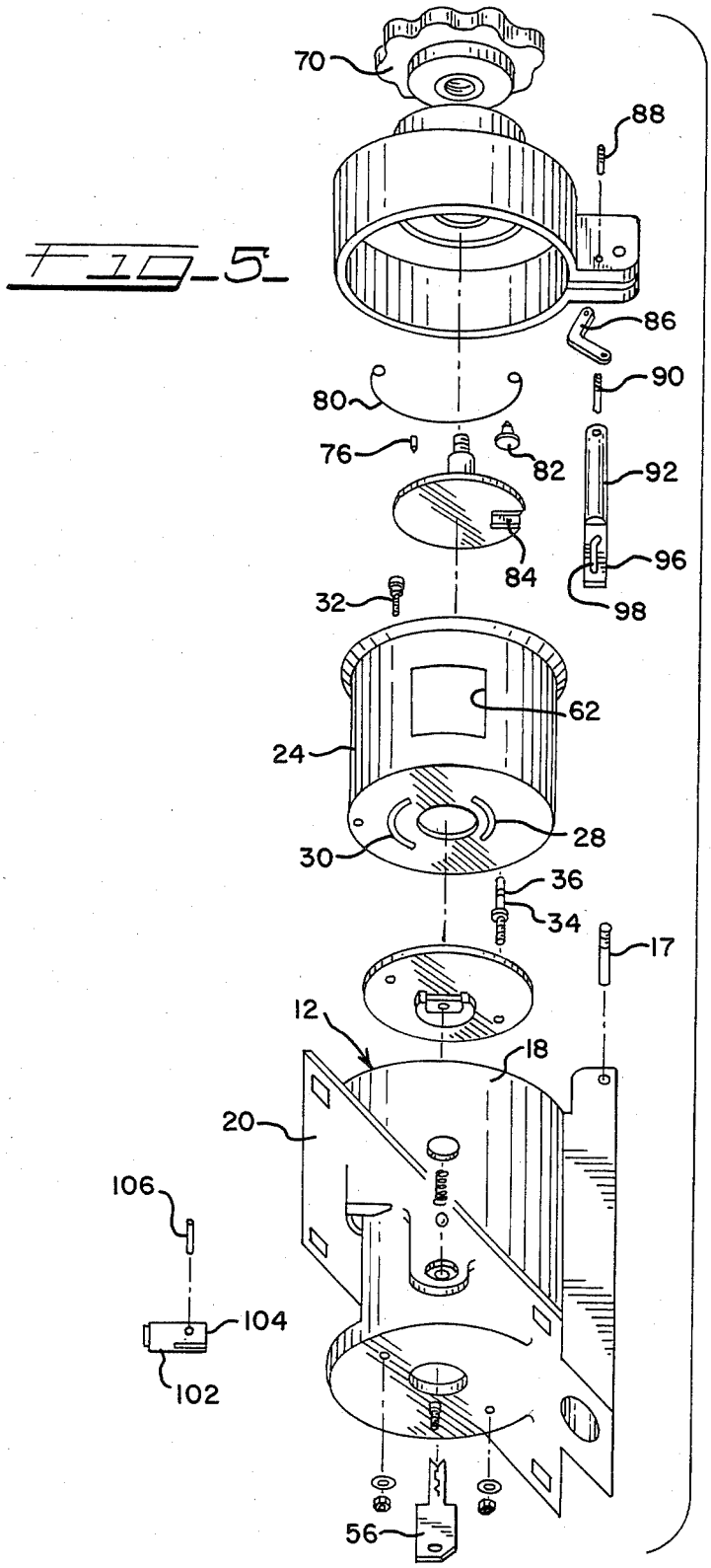
FIG. 5 is an exploded view of the components of the receiver housing.

The drawings illustrate an arrangement of the general type shown in the aforementioned Sollenberger U.S. Pat. No. 2,815,166. Thus, the mechanisms illustrated are associated with a coin container housing, the upper wall of which is shown at 10. A receiver housing 12 is mounted on this upper wall, and the receiver housing defines a recess dimensioned to receive coin box 14. A cover 16 is hinged to the receiver housing by means of pin 17.

The receiver housing defines an outer wall 18 which is formed integrally with flange portions 20, these flange portions defining openings to permit securing of the housing to the wall. A rotatable inner sleeve 24 is positioned within the housing, and the recess defined by this inner sleeve is dimensioned for receiving the cash box 14.

As explained in the Sollenberger patent, a spring-loaded detent ball may extend from the outer wall 18 for normal positioning within an opening defined by the inner sleeve 24. This detent ball is depressed by a coin box inserted within the housing recess, and this would ordinarily free the inner sleeve for rotation within the housing.

The sleeve 24 defines arcuate slots 28 and 30. The slot 30 receives the shank of screw 32, and this arrangement limits the degree of rotation of the inner sleeve. The slot 28 receives post 34, this post defining a reduced diameter portion 36.

The cash box 14 consists of an outer housing 38 defining a slot 40 in top wall 42 for receipt of coins. The side wall of the coin box defines a rectangular opening 44, and this opening is normally closed by means of a shutter assembly including wall 46.

As also explained in the Sollenberger patent, this shutter assembly is normally locked against rotation by means of a lock 52, and insertion of a proper key frees the outer housing 38 for rotation relative to the shutter assembly. When the housing is moved a sufficient distance, the opening 44 is exposed whereby the contents of the cash box are dumped out.

A key 56 is positioned within the recess defined by sleeve 24, and this key fits the slot 54 of lock 52. Accordingly, when the cash box is inserted within the recess and then rotated, the opening 44 is cleared. The cash box bottom wall 57 also defines an opening 58 which receives pin 60 mounted on the sleeve 24. This arrangement results in driving of the sleeve 24 along with the cash box housing whereby the sleeve can also rotate as the opening 44 is being cleared. As shown in the Sollenberger patent, the sleeve defines an opening 62 which is aligned with opening 44 when the cash box is inserted and which, upon rotation, remains in alignment with the opening 44.

The Sollenberger structure also provides an interlock between sleeve 24 and cash box 14, once rotation of the latter begins. Specifically, pin 34 is received within the slot 28 of the sleeve, and this pin also passes into enlarged end 64 of cash box slot 66 when the cash box is inserted. As cash box rotation begins, the reduced diameter portion 36 of the pin is received in the narrower portion of the slot 66, so that the cash box is temporarily confined against removal.

The wall 18 of the receiver housing 12 defines an opening 68. During normal operation of the system, rotation of the cash box results in alignment of the openings 44, 62 and 68 when rotation is complete. Accordingly, the contents of the cash box are free to fall into the coin container.

In accordance with the specific concepts of this invention, the door 16 is provided with a rotatable handle 70 which is utilized for purposes of achieving the cash box rotation. This handle is attached by means of locking pin 71 and spindle 72 to a cash box engaging head 74. The head 74 carries a pin 76 which is movable in arcuate groove 78 during handle rotation, the groove limiting the degree of rotation.

A spring 80 has one end positioned around pin 76 and the other end fixed to the handle at the end of groove 78 by means of fastener 82. Rotation of the handle is in opposition to spring 80 whereby upon release of the handle, the spring 80 will cause the handle to automatically return to its starting position.

The engaging head 74 carries insert means 84 which is adapted to be received in coin slot 40 when the cover 16 moves to the closed position. This insert means thus serves as the drive means for the cash box when handle 70 is operated.

A link 86 is positioned adjacent the hinge pin 17 utilized for attaching the cover to receiver housing 12. One end 88 of the link 86 is attached to the cover and the other end 90 of the link is attached to slide bar 92. This slide bar is movable within passage 94 defined by outer wall 18 of the receiver housing. Opening and closing of the cover 16, therefore, results in reciprocation of the slide bar within the passage 94.

The slide bar 92 includes flattened end 96 having a slot 98 formed therein. The slot 98 includes a first portion which is vertical relative to the axis of the slide bar 92, and a second portion 100 which is slanted outwardly relative to this axis.

A locking bar 102 is mounted perpendicular to the slide bar 92. The locking bar defines a bifurcated end 104 which receives the flattened end 96 of the slide bar. A pin 106 carried by the locking bar extends crosswise of the locking bar for retention by the slot 98 of the slide bar. As will be appreciated when comparing FIGS. 1 and 2, the opening and closing of the cover 16 results in movement of the slot 98 relative to the pin 106 so that the pin shifts from the straight portion of the slot into the slanted portion 100.

The apparatus illustrated will typically be used for collecting coins initially deposited in a series of coin boxes. As explained, a typical application will involve use in connection with parking meters wherein a mobile cart is moved along the street with the individual responsible for collection opening each meter retrieving the cash box therefrom.

At this stage, the individual will open the cover 16 of the receiver housing and insert a cash box 14 as shown in FIG. 2. It will be noted that when in this open position, the locking bar 102 has moved into the opening 105 defined by sleeve 24 so that it is not possible to rotate this sleeve. Furthermore, since the locking bar 102 is blocked from inward movement by the pin 106, an individual cannot push the locking bar out of the locking position. Plug 107 is used to cover opening 105.

Once the cash box 14 has been fully inserted, the key 56 will unlock the box thereby permitting rotation of the outer housing 38 of the box relative to the shutter assembly including wall 46. As long as the cover 16 is open, however, rotation of the cash box is not possible since the locking bar 102 remains in engagement with sleeve 24.

As the cover 16 is moved to the closed position, the slide bar 92 will move generally downwardly relative to pin 106 of the locking bar 102. It will be noted, however, that due to the straight portion of slot 98, the majority of this downward movement does not affect the position of the locking bar 102. In fact, the length of the straight portion of the slot 98 is such that the pin 106 will not reach the slanted portion 100 of the slot until the door is substantially closed. More specifically, the downwardly depending wall portion 108 of the cover 16 will have passed the top of the cash box 14 before the pin 106 moves into the slanted portion 100 so that access between the cover and the top of the cash box is prevented for practical purposes during all times that the sleeve 24 is freed for rotation.

Rotation of the sleeve 24 becomes possible when the pin 106 is driven outwardly as it becomes retained within the slanted portion 100 of the slot 98. This results in removal of the end of locking bar 102 from the opening 105 in the sleeve 24. Only at this time is the handle 70 freed for rotation so that the opening 44 of the cash box can be moved into registry with the opening 68 of the receiver housing. Similarly, this rotation of the cash box moves the opening 62 of the sleeve 24 into registry with the opening 68 due to its interaction with pin 60 as explained in the aforementioned Sollenberger patent.

It will be understood that various changes and modifications may be made in the above described construction which provide the characteristics of this invention without departing from the spirit thereof particularly as defined in the following claims.

I claim:

1. In a coin collection apparatus including a coin container, a receiver housing on the container, and a recess defined by the receiver housing for receiving a coin box, said coin box defining an opening whereby coins deposited in said box can be discharged into said container, a closure for said opening, said closure being opened upon movement of said box within said housing, the improvement comprising a cover for said receiver housing, means permiting placement of the cover in a position to close access to the receiver housing when a coin box is positioned within said recess, a coin box engaging head carried by said cover and movable relative to said cover, means defined by said engaging head for engaging said coin box, a handle carried by said cover, and means connecting said handle to said engaging head whereby movement of said handle results in movement of the engaging head and coin box to achieve opening of said closure and discharge of said coins into said container.

2. An apparatus in accordance with claim 1 wherein said coin box comprises a cylindrical structure, said recess being cylindrical in shape and dimensioned to receive said coin box, and wherein said coin box rotates about its axis when moved by said engaging head.

3. An apparatus in accordance with claim 2 wherein said coin box defines a coin receiving slot, said engaging head carrying an insert means receivable within said slot upon closing of said cover to achieve said engagement between said head and said box.

4. An apparatus in accordance with claim 3 including a rotatable handle carried on the exterior of said cover, said engaging head comprising a plate means positioned on the interior of said cover and carrying said insert means, and a shaft interconnecting said handle and said plate means whereby rotation of the handle rotates said plate means.

5. An apparatus in accordance with claim 2 wherein said recess is defined by means of a rotatably mounted sleeve, an opening defined by said sleeve for registry with said coin box opening, and including an additional opening defined by said receiver housing for registering with said coin box opening and with said sleeve opening whereby coins can only be discharged from said coin box when the three openings are in registry, and including locking means for locking said sleeve against movement when said cover is opened.

6. An apparatus in accordance with claim 5 wherein said locking means comprise a locking bar, a locking bar receiving opening defined by said sleeve means, and linkage means connecting said locking bar to said cover whereby opening and closing of said cover operates to shift said locking bar into said bar receiving opening to achieve locking of said sleeve against rotation, and out of said bar receiving opening to achieve release of said sleeve.

7. An apparatus in accordance with claim 6 wherein said linkage means include a slide bar, a link between said slide bar and said cover whereby opening and closing of the cover reciprocates the slide bar along a vertical path, a pin carried by said locking bar, a slot defined by said slide bar and receiving said pin, said slot including a vertical portion and a second portion closer to said cover and slanted outwardly from said vertical portion, said pin being retained by said vertical portion of said slot during opening and closing of said cover and said locking bar being thereby held in said locking bar receiving opening, and said pin being retained by said second slot portion as said cover is closed, movement of the pin from said vertical slot portion to said second slot portion operating to shift said locking bar out of said locking bar receiving opening.

* * * * *